US006773790B2

(12) United States Patent
Lasson

(10) Patent No.: US 6,773,790 B2
(45) Date of Patent: Aug. 10, 2004

(54) CREASE-LINED PACKAGING LAMINATE, A METHOD OF PROVIDING A PACKAGING LAMINATE WITH CREASE LINES, AND PACKAGING CONTAINERS PRODUCED FROM THE LAMINATE

(75) Inventor: Rolf Lasson, Lund (SE)

(73) Assignee: Tetra Laval Holdings & Finance, SA, Pully (CH)

( * ) Notice: Subject to any disclaimer, the term of this patent is extended or adjusted under 35 U.S.C. 154(b) by 0 days.

(21) Appl. No.: 09/214,022

(22) PCT Filed: Jun. 19, 1997

(86) PCT No.: PCT/SE97/01102

§ 371 (c)(1),
(2), (4) Date: Dec. 23, 1998

(87) PCT Pub. No.: WO98/00350

PCT Pub. Date: Jan. 8, 1998

(65) Prior Publication Data

US 2001/0031337 A1 Oct. 18, 2001

(30) Foreign Application Priority Data

Jul. 1, 1996 (SE) ..... 9602607

(51) Int. Cl.[7] ..... B65D 5/42

(52) U.S. Cl. ..... 428/156; 428/156; 428/198; 428/207; 428/214; 428/542.8

(58) Field of Search ..... 428/152, 198, 428/207, 214, 542.8, 153, 154, 343, 212; 229/125.42, 930, 939; 156/289, 227, 196

(56) References Cited

U.S. PATENT DOCUMENTS 2,218,246 A * 10/1940 McGrady ..... 229/164.2
2,276,363 A * 3/1942 Zalkind ..... 428/124
2,558,918 A * 7/1951 Zinn ..... 229/137
2,837,261 A * 6/1958 Stenger ..... 229/192
3,078,768 A * 2/1963 Kuchenbecker ..... 493/96
4,206,867 A * 6/1980 Skjelby ..... 229/17 G
4,712,737 A * 12/1987 Hecking ..... 206/0.5
4,909,432 A * 3/1990 Nagata ..... 229/137
5,763,049 A * 6/1998 Frey et al. ..... 428/172
5,846,358 A * 12/1998 Nagamoto ..... 156/64

* cited by examiner

*Primary Examiner*—Harold Pyon
*Assistant Examiner*—Alicia Chevalier
(74) *Attorney, Agent, or Firm*—Welsh & Katz, LTD.

(57) ABSTRACT

The disclosure relates to a crease-lined packaging laminate (20) which makes for more distinct and well-formed fold edges and thereby packaging containers with an attractive appearance and good configurational stability and handling stability, as well as a simple method of providing a packaging laminate with crease lines, which makes for more rational, and more economical changing of crease line patterns without the employment of expensive creasing tools. A packaging laminate (20) comprising at least two layers (11, 12) which both contribute to the total rigidity of the packaging laminate is provided with fold indications in that the adhesion between the two layers is reduced or eliminated along the linear regions along which the packaging laminate is to be folded. Since both of the layers can be deformed more independently of one another along the linear adhesion reduced fold regions (14), the total flexural resistance of the packaging laminate is less in these regions than in the rest of the packaging laminate. The adhesive bonding strength between the two layers (11, 12) may, for example, be reduced by applying an adhesion-counteracting agent on one or both of the layers within the linear crease line regions, or by applying an adhesion-promoting agent in the regions outside these crease line regions. In particular, the adhesion may be reduced by bringing the two layers to surface fusion with one another by the supply of heat to regions outside the crease lines. For example, the surfaces in the regions outside the crease lines may be darkened or blackened in order to absorb more heat than the relatively lighter crease line regions.

8 Claims, 2 Drawing Sheets

Figure 1A:
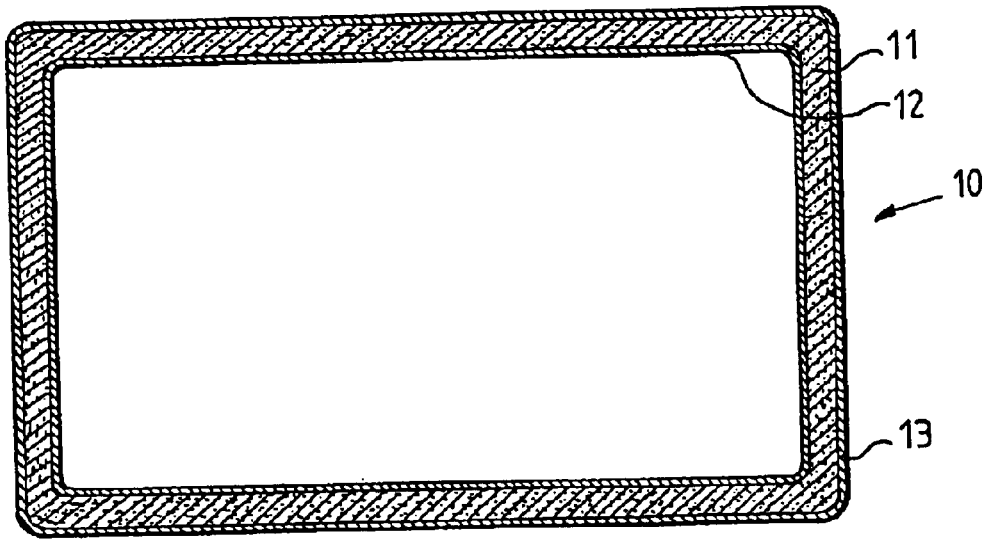

CREASE-LINED PACKAGING LAMINATE, A METHOD OF PROVIDING A PACKAGING LAMINATE WITH CREASE LINES, AND PACKAGING CONTAINERS PRODUCED FROM THE LAMINATE

TECHNICAL FIELD

The present invention relates to a crease-lined packaging laminate comprising at least two layers. The present invention also relates to a method of producing the crease-lined packaging laminate, and also to packaging containers produced from the crease-lined packaging laminate by fold forming.

BACKGROUND ART

Use has long been made in the packaging industry of packages of the single-use type for packing and transporting liquid foods. Such so-called single-use disposable packages are often manufactured from a flexible material which, by fold forming and sealing, is converted into filled, sealed packaging containers of the desired shape. A very large group of these disposable packages is produced from a laminated packaging material comprising a core layer of paper or paperboard and outer, liquid-tight coatings of plastic on both sides of the core layer. The packaging laminate may also include additional layers of plastic and/or metal in order to impart to the packaging containers superior barrier properties against, for example, gases and light.

While the packaging material is in the unfolded, planar state, it is often provided with lines of weakness, so-called crease lines, for facilitating folding with the purpose of facilitating the conversion of the packaging material into packaging containers of the desired configuration.

Conventionally, such crease lines are realised by placing the packaging material intended for creasing between moving male and female parts of a creasing tool which, by pressing, deforms and impresses the desired weakening pattern in the packaging material. The deformation takes place in that the packaging material is, along the intended fold lines, pressed into grooves in the female part of the tool by means of linear projections or ridges on the surface of the male tool. A packaging material with crease lines produced in this manner displays a positive and a negative side, i.e. the creasing tool gives rise to an elevated linear (ridge-like) deformation of the one, positive side of the packaging material, and a corresponding linear depression on the other, negative side of the packaging material.

A pattern of such crease lines may be obtained on processing of planar material sheets by means of press plates or by so-called rotation creasing, i.e. creasing of a continuous web by means of two cooperating rotary rollers with complementary channels or grooves and ridges or beads respectively.

The conventional method of realising crease lines makes for a simple folding process with distinct folding lines, but changes in the process entail high costs and extensive work, since each specific crease line pattern and each specific packaging material, with specific thickness and quality, requires its unique creasing tool with adapted widths and depths in the grooves and ridges.

A further drawback inherent in the conventionally crease-lined packaging material is that the folded side edges of the packaging container tend to have a rounded, blunt appearance. On fold forming along the crease line, the raised linear deformation of the packaging material is compressed on the positive side of the packaging material, on the inside of the packaging container, forming ridges or accumulations of packaging material. Since the relatively large accumulation of compressed packaging material is located centrally in the fold, and because of the relative resilience of the fibres gathered in the material accumulation, tensions and forces arise in the fold edge because of the material's propensity to "spring back" to its original planar form. As a result of these resilient return forces, the fold edges of the packaging container will become readily gently rounded with a tendency to be flattened on external loading, for example from the grip of a hand, which gives the package an impression of poor grip rigidity.

A known method of realising better defined folds in a packaging container is described in Swedish Patent Application carrying publication number 467302. By removing the above mentioned raised linear deformation on the positive side of the packaging material, by mechanical processing such as milling, subsequent folding of the packaging material is facilitated at the same time as the material is weakened along the crease line and the return resilience forces in the fold region are reduced. However, this method suffers from the drawbacks that the surface of the packaging material on the inside of the packaging container is locally destroyed in the crease line region, and that the strength of the fold is reduced as a result of the removal of material. Moreover, dust and/or waste material are created which need to be taken care of.

OBJECTS OF THE INVENTION

One object of the present invention is therefore to realise a crease-lined packaging material of the type described by way of introduction, without consequential problems of the type intimately related to the prior art techniques and methods.

Another object of the present invention is to realise a crease-lined packaging material of the type described by way of introduction which makes for sharper, better defined folds of the packaging material and thus better formed edge lines and corners in a packaging container.

Yet a further object of the present invention is to provide a method for realising crease lines in a packaging material of the type described by way of introduction, obviating complex, conventional creasing processes using relatively expensive creasing tools, and to make for simpler, more rational and more economical changes of crease line patterns on switching between different package sizes and packaging material qualities.

Still a further object of the present invention is to realise a better formed packaging container possessing improved configurational stability and gripping stability on the action of external forces.

SOLUTION

These and other objects are attained by means of a laminated packaging material comprising at least two layers wherein the adhesive bonding strength between the at least two layers is reduced or eliminated along the crease lines of the packaging laminate. One of the layers can be locally treated along the crease lines in order to counteract adhesion of the adjacent layer. The adhesion counteracting agent can be applied between the layers along the crease lines.

Preferably, one of the layers is paper or paperboard. The second layer can be aluminum foil or a greaseproof paper.

A method for producing a crease-lined packaging laminate in accordance with the present invention includes applying an adhesion counteracting agent in the regions of the crease lines between the at least two layers. Another method for producing a crease-lined packaging laminate in accordance with the present invention includes applying an adhesion-promoting agent in the regions outside of the crease lines between the at least two layers. Alternately, the at least two layers are adhered to one another by heating the laminate and an insufficient quantity of heat is applied to the regions of the crease lines.

In practicing these methods, the adhesion-promoting agent can be a UV-curing or EB-curing agent and curing can be carried out by subjecting the laminate to UV- or EB-radiation after the two layer have been laid together. The adhesion can also be carried out by heating the layers wherein the regions of the crease lines absorb an insufficient quantity of heat for adhesion. Differential heating can be carried out by blackening or darkening the surfaces on the at least one layer, leaving the regions of the crease lines white or light and subjecting the laminate to IR-radiation.

In use, the laminate can be used to make packaging containers.

Furthermore, the present invention provides a grip stable packaging container with well-defined side edges which is produced by fold forming of a packaging laminate according to the present invention.

By selectively reducing or eliminating the bonding adhesive strength between the layers in a packaging laminate which comprises at least two such layers, along the linear regions along which the packaging laminate is to be folded, relatively complex, conventional creasing processes using expensive creasing tools can be obviated, at the same time as the fold edges of the packaging container will be more distinct and the packaging container will thereby be given attractive appearance with good handling stability and durability.

BRIEF DESCRIPTION OF THE ACCOMPANYING DRAWINGS

Figure 1B:
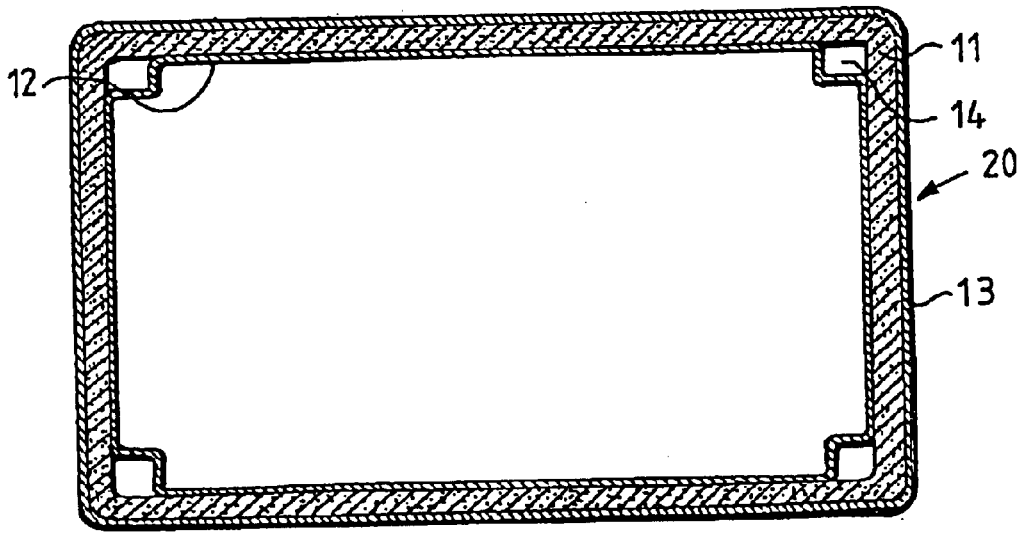
Figure 2:
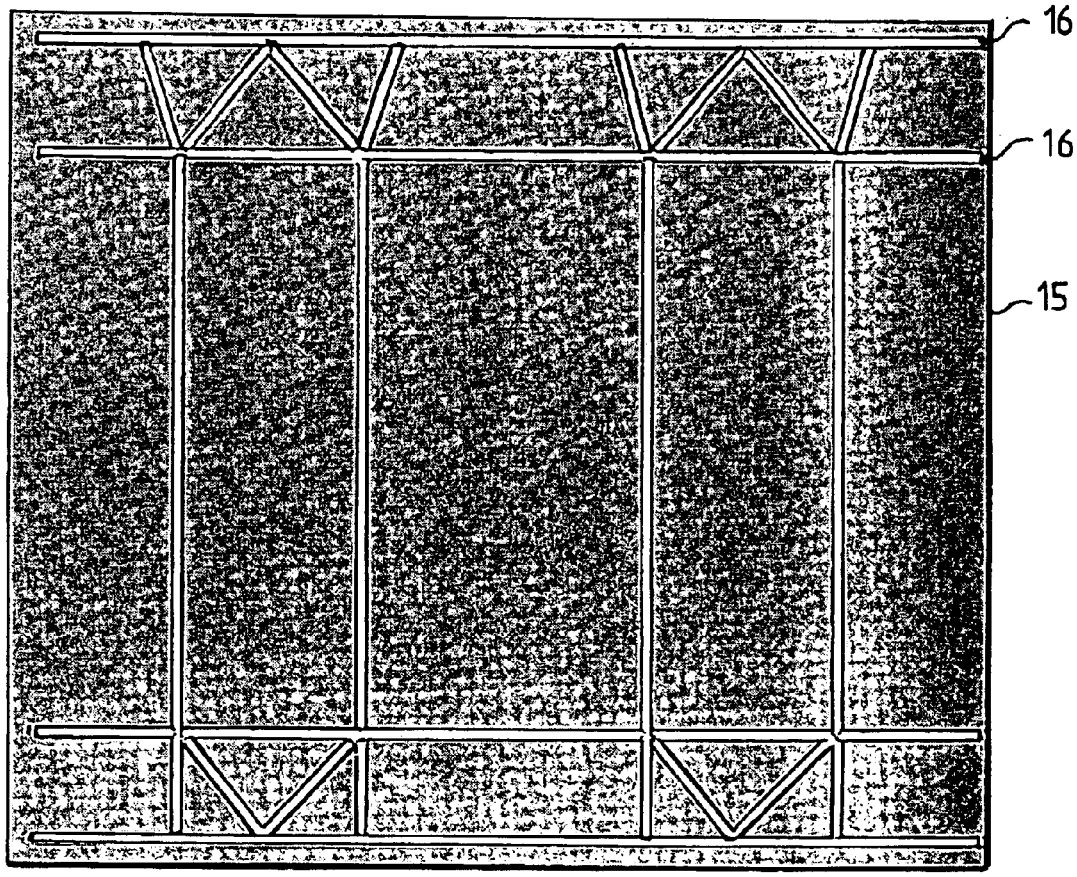

The above-outlined aspects of the present invention will now be described in greater detail hereinbelow, with particular reference to the accompanying Drawings, in which:

FIGS. 1*a* and 1*b* schematically illustrate a cross section of a packaging container of a conventionally laminated packaging material and a laminated packaging material according to the present invention, respectively; and FIG. 2 schematically illustrates one example of a crease-lined packaging material according to one embodiment of the present invention.

While the present invention will be described in greater detail with reference to specific embodiments shown on the Drawings, it will be obvious to a person skilled in the art that different modifications and variations may be made without departing from the inventive concept as this is defined in the appended Claims.

DESCRIPTION OF PREFERRED EMBODIMENT

FIG. 1*a* thus shows a cross section of a packaging container of a conventionally creased packaging laminate 10. Examples of such conventional packaging containers are Tetra Brik® or Tetra Rex®. The conventional packaging laminate 10 comprises a core layer or carrier layer 11 of paper or paperboard and a layer 12 disposed on the inside of the core layer.

The layer 12 is normally a gas or light barrier layer of, for example, an aluminium foil (Alifoil) or a metalised plastic film, such as aluminised, oriented polypropylene or aluminised, oriented polyester. The concept "metalised" implies that a thin layer of metal has been deposited on a surface by means of known deposition techniques such as, for example, the CVPD technique (Chemical Vapour Plasma Deposition), and encompasses metal oxides such as, for example, silicon oxide (SiOx, where x is between 1.5 and 2.2). The layer 12 may also consist of a so-called greaseproof layer of the glassine type or greaseproof paper.

In conventional creasing, the total flexural resistance of the packaging laminate is reduced along the crease zones by linear deformation of the packaging laminate. The packaging material 10 thus has raised linear deformations on the inside of the packaging material, which, during the fold forming operation, are compressed on the inside of the corners of the fold edges. On fold forming, the inside of the packaging laminate is pressed with these raised linear deformations together in the corners of the folded side edges on the inside of the packaging container. The folded side edge corners will be less distinct, since the compressed packaging material on the inside of the fold corners tends to "spring back" to the uncompressed state.

FIG. 1*b* shows the same type of packaging container of a packaging laminate 20 comprising the same material layers but with crease lines according to the present invention. The packaging material 20 has been provided with fold indications by reducing, or preferably eliminating the adhesive bonding strength between the core layer 11 and the layer 12 laminated on the inside of the core layer along the fold indications.

In a laminate of two layers in which both layers adhere to one another in blanket fashion, the rigidity of the core layer 11 affects the folding process in the core layer 12, and vice versa. During the folding process, the one material layer is influenced by resistive forces and tension which arise because of the fact that the material rigidity of the second layer strives to accompany the first layer in the folding operation. When adhesion is reduced or eliminated between the two layers in the fold regions, the two layers need not, on the other hand, accompany one another in the folding, and therefore do not affect each other as much during the folding process.

Since the layers 11 and 12 can be deformed more independently of one another along the linear adhesion-reducing fold indications, they have no influence on each other's flexural rigidity during the folding process. The layer 12 thus makes no contribution in the total rigidity of the laminate by being laminated to the layer 11, and vice versa, whereby the total flexural resistance along the linear fold regions will less than in the rest of the packaging material.

Since the total flexural resistance is lower in the linear fold indication regions, within which the adhesive bonding strength is reduced or eliminated, the packaging material becomes more easily folded, i.e. deformable along these regions than in other regions of the packaging material. In regions where the layers are adhesion-reduced or adhesion-free, the flexural resistance thus consists substantially only of the flexural resistance of the more rigid of the layers. The total flexural resistance in the above-mentioned linear fold indication regions is estimated in the packaging laminate 20 to be approximately as great as the total flexural resistance in a conventional crease line in the same packaging laminate. The linear regions with reduced or eliminated adhesion thus constitute distinct fold indications in the packaging material without the packaging material having been deformed in any way beforehand.

Such fold indications will be more distinct and easily folded if both layers are relatively rigid, i.e. contribute to the total rigidity and flexural resistance of the packaging laminate, as is, for instance, the case when a core layer and a layer comprising an aluminium foil are laminated.

Another packaging laminate according to the invention may be crease-processed both by conventional mechanical deforming and by adhesion-reduction or adhesion-elimination between the layers in the fold regions. Such a "double creased" packaging laminate achieves better defined folds and corners in the fold-formed packaging container and lower flexural resistance as compared with exclusively conventional mechanical deformation.

The linear weakening regions according to the present invention should be sufficiently wide to give the requisite weakening in the packaging material, i.e. to facilitate folding, at the same time as they must be sufficiently narrow to give a sharp, straight and well-defined side edge on fold forming. The width of the crease line thus depends on the material properties and thicknesses of the layers included in the packaging laminate, and hence varies for different packaging laminates. In a conventional packaging laminate with a core layer of paper or paperboard and an aluminium foil, the width of the crease line is preferably between approximately 1 and 3 mm.

The reduction or elimination of the adhesive bonding strength between the two layers 11 and 12 as disclosed above may be realised in different ways. According to one method, an adhesion-counteracting agent is applied on one or both of the layers within the linear fold regions. The term adhesion-counteracting agent is taken to signify an agent which possesses adhesion-counteracting properties vis-à-vis one or both of the layers between which the adhesion is to be reduced. Such agents are known to persons skilled in the art.

According to another method, an adhesion-promoting agent is instead applied to one or both of the layers in the regions outside the above-mentioned linear regions, but not within them. Such an adhesion-promoting agent thus has good adhesive properties in respect of both of the layers which are to be laminated. Adhesion-promoting agents and glues of all types are conceivable, and also compositions which harden or cure with the aid of heat (IR-), UV- or EB (Electron Beam) radiation. Adhesion is achieved in that the adhesion-promoting agent is applied to one of both of the layers which are to be laminated to one another, that both of the layers are laid together and are thereafter cured with the aid of heat, UV- or EB-radiation respectively. For such radiation curing to function, the materials involved must be adapted to each respective type of radiation and, in the latter two cases, the layer placed most proximal the source of radiation must be permeable for the radiation. Thus, a UV curing composition can cure after the layers intended for lamination have been laid together only if the layer disposed most proximal the radiation is permeable for UV light, such as, for example, a transparent plastic layer.

One special method of laminating two layers to one another is based on the concept of bringing the two layers to surface fusion with one another by the supply of heat within the regions outside the crease lines. This presupposes that the layers are thermosealable or are provided with thermosealable outer layers. One such thermosealable layer is, for example, polyethylene. Higher adhesion bonding strength between the two layers in the regions outside the linear fold regions is achieved by selectively treating the surface of one or both of the layers which are to be laminated to one another such that the regions outside the above-mentioned linear fold regions absorb sufficient heat for surface fusion, and that the surfaces within the linear fold regions absorb an insufficient quantity of heat for surface fusion. For example, the surfaces in the regions outside the linear fold regions (FIG. 2; (15)) are darkened or blackened in order to absorb more heat on IR-radiation than the relatively lighter surfaces in the fold regions (16).

The selective treatment of the layers may take place with the aid of known printing techniques. Both the adhesion-counteracting and the adhesion-promoting agents, like the dark or black colour, may be applied using printing rollers. FIG. 2 shows an example of a conventional crease line pattern which has been darkened or blackened on one layer in the regions outside the linear fold regions (15).

Under the action of external forces, such as, for example, from a gripping hand, on a folded side edge according to the invention, the external forces are divided up into force components in the plane which is defined by the side walls of the packaging container. Compared with conventional packaging containers which have a less well-defined configuration because of less distinct side edges, and in which such force components tend to deviate from the plane of the side walls, the outward bulging of the side walls of the packaging container which normally occurs under the action of such external forces is reduced and the folded side edge is better capable of withstanding the tendency to weaken and give way. A packaging container produced by fold forming of a packaging material creased by the method according to the present invention is thus more stable to grasp hold of and handle.

As will be have been apparent from the foregoing description, the present invention thus makes it possible to avoid relatively complicated, conventional folding processes using expensive folding tools, and makes for simpler, more rational and more economical changing of crease line patterns on switching between different package sizes and packaging material qualities, at the same time as the folded side edges in packaging containers produced from the packaging laminate will be more distinct and, as a result, the packaging container according to the present invention is given an attractive appearance with good handling stability and handling durability.

What is claimed is:

1. A packaging laminate comprising:

a first layer;

a second layer bonded to the first layer having a first bond strength, the first and second layers being coextensive with one another;

a plurality of linear fold regions, each fold region overlying and defining a corresponding crease line of the packaging laminate, the plurality of linear fold regions having a bond strength less than the first bond strength, wherein when the laminate is folded at the crease lines, the first and second layers separate from one another; and a liquid-tight coating disposed on the first layer outwardly of the second layer and a liquid-tight coating disposed on the second layer outwardly of the first layer.

2. The packaging laminate according to claim 1 wherein the linear fold regions are treated with an adhesion counteracting agent.

3. The packaging laminate according to claim 1 wherein the non-fold regions are treated with an adhesion agent.

4. The packaging laminate according to claim 1 wherein the first layer is paperboard and the second layer is selected from the group consisting if aluminum or a greaseproof paper.

5. A packaging container comprising:

a first layer having a first plurality of linear fold regions, each linear fold region defining a corresponding crease line of the packaging container, the first layer also having a first plurality of non-fold regions;

a second layer coextensive with the first layer, the second layer having a second plurality of linear fold regions, each of the linear fold regions defining a corresponding crease line of the packaging container, the second layer also having a second plurality of non-fold regions, the first layer first plurality of non-fold regions being bonded to the second layer second plurality of non-fold regions at a first bond strength greater than a bond strength of the first layer first plurality of linear fold regions and the second layer second plurality of linear fold regions, wherein when the bonded first and second layers me folded at the crease lines, the first and second layers separate from one another at the liner fold regions; and a liquid-tight coating disposed on the first layer outwardly of the second layer and a liquid-tight coating disposed on the second layer outwardly of the first layer.

6. The packaging containing according to claim 5 wherein the non-fold regions of at least one of the first and second layers is darkened relative to the linear fold regions.

7. The packaging container according to claim 5 further comprising an adhesion counteracting agent applied to at least one of the plurality of linear fold regions.

8. The packaging container according to claim 5 further comprising an adhesion agent applied to at least one of the non-fold regions of the packaging container.

* * * * *